United States Patent [19]

Tsai

[11] Patent Number: 4,807,773

[45] Date of Patent: Feb. 28, 1989

[54] VERTICALLY ASSEMBLED COMPACT

[76] Inventor: Aaron Tsai, 10F-3, No. 4,530 Lane, Ming Sheng E. Rd., Taipei, Taiwan

[21] Appl. No.: 99,010

[22] Filed: Sep. 21, 1987

[51] Int. Cl.[4] ..... B65D 6/00

[52] U.S. Cl. ..... 220/4 D; 206/823; 206/509; 206/501; 132/296

[58] Field of Search ..... 132/82 R, 82 C, 82 D, 132/82 E, 82 F, 83 R, 83 C, 83 F, 83 G, 79 R, 79 D, 79 F, 79 G; 220/4 C, 4 D, 336; 206/581, 823, 509, 506, 501, 512, 558, 557, 564; 312/120, 136, 123, 326, 305

[56] References Cited

U.S. PATENT DOCUMENTS

| | | | |
|---|---|---|---|
| 1,632,864 | 6/1927 | Weber | 132/83 R |
| 1,701,860 | 2/1929 | Mullen | 132/83 R |
| 1,951,214 | 3/1934 | Schlumbohm | 132/83 R |
| 2,077,219 | 4/1937 | Conner | 132/82 D |
| 3,379,492 | 4/1968 | Lovercheck | 132/82 R |
| 3,441,033 | 4/1969 | Flax | 132/82 R |

*Primary Examiner*—Gene Mancene
*Assistant Examiner*—Adriene J. Lepiane
*Attorney, Agent, or Firm*—Wenderoth, Lind & Ponack

[57] ABSTRACT

A vertical compact device assembled with several body portions, which are designed to accommodate eyelash pencil, rouge cream or lipstick, and cosmetic tools, etc. The compact can be coated in different colors to indicate the same color cosmetics therein for the convenience of the user. The compact so assembled is a portable compact, taking a small space.

4 Claims, 2 Drawing Sheets

VERTICALLY ASSEMBLED COMPACT

BACKGROUND OF THE INVENTION (a) Field of the Invention

This invention relates to a compact to be assembled vertically i.e., the several body portions of the compact can be vertically assembled together by means of several connecting pivots and pivot holes in a rotary manner. It is a small and portable compact for female users.

(b) Description of the Prior Art

Currently, the cosmetics such as eylash pencil or rouge cream are usually put in a flat box; the size of that flat box is varied in accordance with the cosmetics and their colors, and therefore more cosmetics and more colors thereof would require more space; as a result, more cosmetics would cause inconvenience to a user to carry around.

SUMMARY OF THE INVENTION

The prime object of the present invention is to provide a vertically assembled compact for holding a set of cosmetics, such as eyelash pencil, rouge cream, lipstick and some cosmetic tools so as to save space and to facilitate the user to carry the compact conveniently.

Another object of the present invention is to provide a vertically assembled compact, of which the body portions may be coated in different colors so as to facilitate the user to locate the specific cosmetic desired. Moreover, the user may re-assemble the body portions according to her own wish to match the desired colors for variety pleasure.

DETAILED DESCRIPTION

Figure 1:
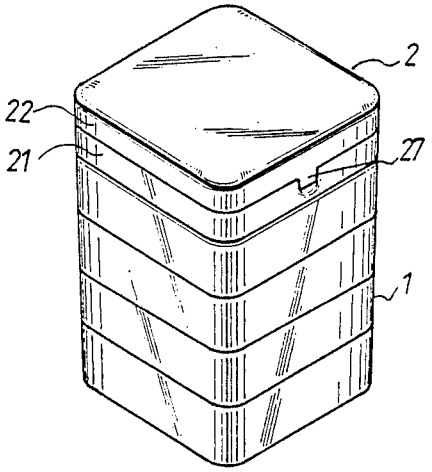
FIG. 1 is a perspective view of a first embodiment of a vertically assembled compact, according to the present invention, which is square.
Figure 2:
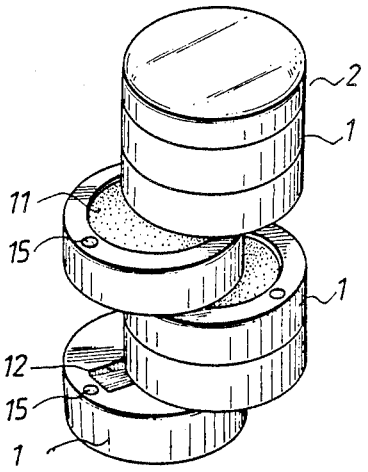
FIG. 2 is a perspective view of a second embodiment of a vertically assembled compact, according to the present invention, which is round.
Figure 4:
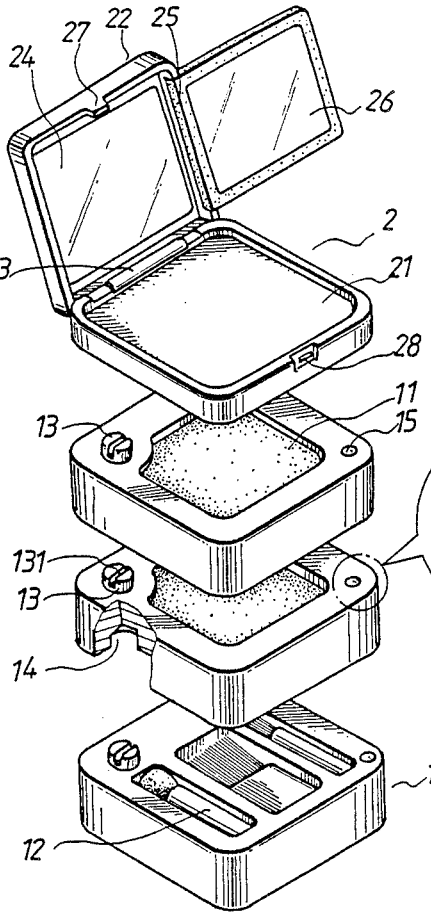
FIG. 4 is an exploded view of the first embodiment.

The compact of invention mainly comprises several body portions 1 and a top lid 2. Both the body portion 1 and the lid 2 are in the same shape; for instance, FIG. 1 and 4 show a square embodiment, while FIG. 2 shows a round embodiment. The compact may be in other shapes such as a sector, an oval or other equilateral polygonal shapes.

Figure 3:
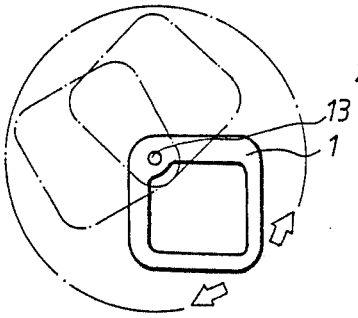
FIG. 3 is a top view of the first embodiment with some parts turned to the open position as shown in phantom lines.
Figure 5:
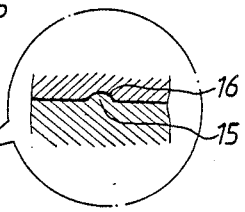
FIG. 5 is a sectional view of a click bead and a click recess between two components of the first embodiment according to the present invention.

FIGS. 1, 3, and 4 shows the first embodiment of the present invention, in which the body portion 1 and the top lid 2 are in a square shape. The top side of each of the body portions 1 is furnished with a powder container 11 for receiving powder foundation, eye-shadow cream, or rouge cream, etc. The powder container 11 can also be modified to provide at least one tool channel 12, to hold a tool such as a small brush, etc. The several body portions 1 are assembled together by means of a round solid core pivot 13 mounted in one corner of each body portion 1. The top of the solid core pivot 13 is furnished with a slot 131. The bottom of each of the body portions 1 is furnished with a pivot hole 14 corresponding to that solid core pivot 13. The inner diameter of the pivot hole 14 is slightly smaller than the outer diameter of the solid core pivot 13 so as to let the top slotted portion of the pivot 13 tightly and elastically insert into the pivot hole 14 smoothly and rotatively by means of the round lead angle portion on the top of the pivot 13. By means of the solid core pivots 13 and the pivot holes 14, the body portions 1 can be assembled and turned freely relative to each other as shown in FIG. 3. On the opposite corner from the solid core pivot 13 on the top side of the body portion 1, there is a click bead 15, which is to be engaged with a click recess 16 on the bottom of the next higher body portion 1 as shown in FIG. 5; by means of the click beads 15 and the click recesses 16, the body portions 1 can be piled together by turning the same.

The top lid 2 comprises an inner lid 21 and and outer lid 22, being assembled together by means of a hinge 23. Under the bottom of the inner lid 21, there are a pivot hole 14 and a click recess 16 so as to let the top lid 2 position on the top of the body portion 1. Inside the outer lid 22 is a mirror 24 and a secondary mirror 26 is mounted in place by means of a hinge 25 to facilitate the user to make up the face. The outer lid 22 and the inner lid 21 can be fastened together by means of a male fastener 27 and a female fastener 28.

In the first embodiment, the top lid 2 and the body portion 1 or one body portion 1 and the next body portion 1 are asesembled together by means of a solid core pivot 13 and a pivot hole 14.

Figure 6:
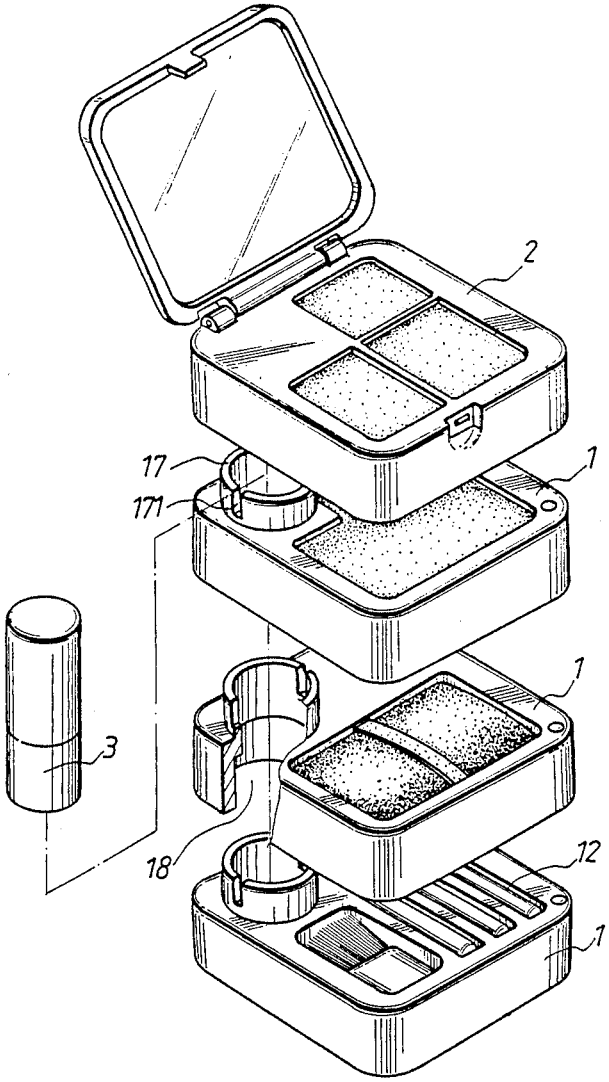
FIG. 6 is a disassembled view of a modified form of the first embodiment, showing the compact assembled together with a hollow core pivot and a through hole.
Figure 7:
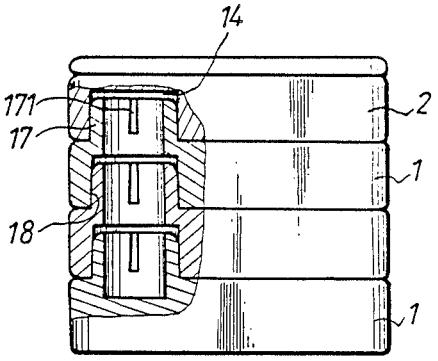
FIG. 7 is a view, partially in section, of the compact of FIG. 6.

FIGS. 6 and 7 illustrate a modified first embodiment of the present invention, in which a body portion 1 and the next body portion 1 or the top lid 2 and the body portion 1 are assembled together by means of a hollow annular pivot 17 and a through hole with an enlarged pivot receiving portion 18; both the hollow pivot 17 and the pivot receiving portion 18 are assembled together co-axially, being mounted at one corner of the body portion 1. The hollow pivot 17 extends into the body portion 1 a suitable distance. On the top end of the hollow pivot 17 are two symmetrical slots 171; the top end edge of the hollow pivot 17 is furnished with a suitable round lead angle. The pivot receiving portion 18 is provided exactly under the bottom of the hollow pivot 17, and the inner diameter of the pivot receiving portion 18 is smaller than the outer diameter of the hollow pivot 17, but the top end of the hollow pivot 17 can be inserted into the portion 18 rotatively by means of the round lead angle and the slots on the top of the pivot 17 as shown in FIG. 7. The body portions 1 can be assembled together by means of the hollow pivot 17 and the portion 18. The special feature of the pivot 17 and the portion 18 assembly is to accommodate a small lipstick 3 or eyelash pencil therein. The bottom of the body portion 1 that has tool channels is not furnished with a through hole so as to provide more space for accommodating a lipstick 3 (or eyelash pencil). The bottom of the top lid 2 is furnished with a pivot hole 14 corresponding to the position of the hollow pivot 17 on the body portion 1 so as to have the hole 14 mounted on the hollow pivot 17. Upon the top lid 2 being separated from the body portion 1, the space for the lipstick 3 (or eyelash pencil) is opened.

According to the structure of the present invention, the body portions 1 may be coated with different colors to accommodate different cosmetics or make-up tools. The user can assemble the compact according to her (or his) free will, and then puts the top lid 2 on the assembled body portions 1 to complete the compact as shown in FIGS. 4 and 6.

Since all the body portions 1 and the top lid are assembled together by means of round pivots and holes the body portions 1 and the top lid can freely be turned relative to each other for user's convenience. Furthermore, since the compact according to the present invention is similar to a rod after being assembled, it is easy to hold and to carry by the user and takes up a very small space.

Although the body portions of the present invention can be used for storing eyelash pencil or rouge cream, powder make-up and lipstick, the user may use it for storing a single cosmetic with a single and smaller assembly as shown in FIG. 2. in that case, the tool channel 12 on the bottom body portion 1 used for storing make-up tools must be changed into a single channel for storing a small brush only. The mirror in top lid 2 may be omitted to make the top lid 2 single in accordance with the requirement of the user.

The outer shape of the major parts in the present invention is all the same; in case the body portions 1 are used for storing only one cosmetic in one color, the body portions 1 may be coated in the same color as that of the cosmetic so as to facilitate the user to pick what color she needs immediately. The body portions may be coated in various colors respectively for visual pleasure.

Briefly, it is deemed that the present invention can substantially meet the consumer's requirement by means of its perfect structure, such as the round solid or hollow pivots and the pivot holes, the rotative feature of the body portions to facilitate the user to select a cosmetic desired, and the features of being portable and taking a small space to put the compact, etc.

I claim:

1. A vertically assembled compact, comprising;

a plurality of generally flat body portions with the top side of each body portion having a recess therein for receiving a cosmetic or a cosmetic tool;

a hollow annular pivot on each body portion projecting from one face of the body portion and the body portion having a through hole therethrough aligned with the hollow interior of the pivot and substantially the same diameter as the inside diameter of the pivot, the through hole having an enlarged pivot receiving portion on the opposite side of the body portion from the side from which the pivot projects and having an inside diameter for receiving a pivot member in a rotatable friction fit;

said body portions assembled with a pivot from one body portion rotatably frictionally fitted into the enlarged pivot receiving portion on the next adjacent body portion, said assembled body portions having a first end body portion on one end and a second end body portion on the other end;

a first end portion having an enlarged pivot receiving recess therein and having a pivot from said first end body portion of the assembled body portions rotatably frictionally fitted into said enlarged pivot receiving recess, and said first end portion being unapertured in the portion thereof aligned with said enlarged pivot receiving recess; and a second end portion having a further hollow annular pivot thereon rotatably frictionally fitted into the enlarged pivot receiving recess on said second end body portion of the assembled body portions, the second end portion being unapertured in the portion thereof aligned with said further hollow annular pivot; whereby the aligned hollow interiors of the pivots and the through holes form a cylindrical recess for receiving a cylindrical cosmetic container therein.

2. A vertically assembled compact as claimed in claim 1 in which said first end portion has a cover hingedly mounted thereon on the side opposite the side with said pivot receiving recess therein, and said recess in said body portions are on the sides thereof facing toward said second end portion.

3. A vertically assembled compact as claimed in claim 1 in which all of said body portions and said first and second end portions have the same peripheral shape, whereby when they are pivoted so as to be aligned, they form a solid geometrical body having a smooth outer peripheral surface from end to end.

4. A vertically assembled compact as claimed in claim 3 in which said peripheral shape is generally rectangular, and said pivots and pivot receiving portions and pivot receiving recesses are in one corner of the rectangular shape.

* * * * *